United States Patent [19]

Campbell

[11] 3,940,085

[45] Feb. 24, 1976

[54] COLLAPSIBLE REEL

[76] Inventor: Kenneth E. Campbell, 4063 Old Orchard Road, York, Pa. 17402

[22] Filed: Feb. 7, 1975

[21] Appl. No.: 547,769

[52] U.S. Cl. ..... 242/115; 242/116; 242/118.4

[51] Int. Cl.[2] ..... B65H 75/22

[58] Field of Search ..... 242/115, 116, 118.4, 118, 242/118.6, 118.61, 77.4

[56] References Cited

UNITED STATES PATENTS

| | | | |
|---|---|---|---|
| 2,652,992 | 9/1953 | Tucker | 242/118.6 |
| 3,565,363 | 2/1971 | Mizuguchi | 242/115 |
| 3,635,421 | 1/1972 | Boland | 242/118.6 |
| 3,836,093 | 9/1974 | Mozina | 242/118.6 |

*Primary Examiner*—Edward J. McCarthy
*Attorney, Agent, or Firm*—C. Hercus Just

[57] ABSTRACT

A collapsible reel comprising a pair of similar flanges connected by a tubular hub composed of at least a pair of similar segments, similar bosses being affixed to a planar surface of each of the flanges, said bosses having arcuate grooves in the peripheral surfaces thereof and the opposite ends of the concave surfaces of the hub segments having arcuate ribs thereon complementary in shape and size to the grooves in said bosses for reception into said grooves, thereby interlocking the flanges to the hub. Bolt means extending through portions of the hub segments and into other portions engage nuts in said other portions to secure the hub segments in operative relationship with each other and interlock to said flanges. The abutting edges of the hub segments also have interfitting lugs and recesses to align the same with each other and insure a cylindrical outer surface on said hub to receive material to be wound thereupon between said flanges.

10 Claims, 9 Drawing Figures

COLLAPSIBLE REEL

BACKGROUND OF THE INVENTION

Many commercial and industrial activities require the use of reels upon which are coiled various lengths, frequently infinite in nature, of many different types of material such as wire, strips of many different types of material in various widths and thicknesses, lengths of connected semi or completely manufactured items such as electrical contacts, electrical terminals and the like. Belting, chain and many other types of products similarly are coiled upon appropriate reels. In many instances, reels are expendable but nevertheless add to the cost of the product carried thereby. Particularly when reels are such size and composition that the cost thereof represents a reasonably substantial expense, such as of the order of one dollar or more, it becomes economical to return empty reels to the supplier for re-use.

Reels of the type referred to which are susceptible to re-use frequently are of a size from about eight or ten inches in diameter and the hubs thereof are at least four or five inches in length and made from suitable material such as synthetic resins or plastics, metal, or otherwise. It is quite common at present for reels of such size and especially larger reels to be of a very bulky nature when packed for shipment to the supplier for re-use and under such circumstances, it is possible for the shipping cost to be such as to deter such re-use, whereby the reels become a waste. Accordingly, it has become expedient in efforts to economize in the cost of coiled products to effect suitable re-use of reels ranging from the sizes referred to above, up to reels of much larger size by making the reels collapsible so that the flanges thereof are separable from the hub and the separated components of the reel may be compactly packed with components of other reels, whereby a plurality of collapsed or separated reel components may be packed compactly either in appropriate containers or by suitable wrappings for less expensive transportation to return the collapsed reels to the supplier for re-use.

Relatively large reels, such as the type employed for the coiling of electrical conduits and cable thereon have often been made of wood heretofore and the heavy wooden flanges are connected to equally heavy wooden hubs by means of a plurality of bolts extending through the flanges and the hub to securely affix the hub and flanges together. Appropriate means must be used however to effect suitable alignment of the hub with the flanges and, when the same are separated in an attempt to compactly arrange the same in a package, quite a number of components have to be accounted for. In addition, substantial manual effort is required to both assemble as well as disassemble such reels incident respectively to preparing the same for re-use or for shipment back to the supplier. The present cost of wood has also greatly discouraged the manufacture and use of heavy wooden reels. Accordingly, the heavy duty reels such as of a type on which electric cable and the like is coiled at present now are manufactured from an appropriate metal such as steel and, further, for purposes of minimizing the weight, certain types of these reels are manufactured from lighter material such as magnesium, aluminum, and otherwise. However, effecting the fabrication of the flanges to the hubs of such reels frequently is of a permanent nature so that the reels cannot be disassembled or collapsed. However, under circumstances where disassembly is possible, extensive bolts and tie-rod means are employed which require appreciable manual operation and manipulation to effect both assembly and disassembly of this type of reel.

One example of collapsible, so-called heavy-duty reel which if formed from magnesium, comprises the subject matter of U.S. Pat. No. 2,585,159, to Morley, dated Feb. 12, 1952. However, said reel employs connecting means between the flanges and hub which is relatively complex and present substantial manufacturing expense due to the intricate nature of certain interfitting parts, not only in conjunction with the means to connect the hub to the flanges but also said reel is provided with cover means extending circumferentially around the entire outer portion of the reel, when filled, presumably also for adding to the strength of the flanges to withstand any distortion imposed upon the same during shipment in view of the substantial weight of the material coiled upon the reel.

The present applicant also recently obtained U.S. Pat. No. 3,822,841, dated July 9, 1974, upon a collapsible reel structure which is very well adapted to be used for the coiling of material thereon where the diameter of the flanges is of the order of not appreciably more than ten or twelve inches and the length thereof is of the order of not substantially more than six or eight inches. It is preferred that said reel be manufactured from synthetic resin and a particular type of means by which the hub members are connected to the flanges is of such nature that it is not readily adaptable to reels of a heavy duty nature and partically of a size apprecialby larger than the dimensions referred to above. Accordingly, for purposes of providing a so-called heavy duty reel which is collapsible and may be capable of containing much heavier loads than those capable of being coiled upon his patented type of reel, the present invention has been developed for purposes of supporting loads, for example, of the range of one thousand pounds or more and in regard to which the diameter of the flanges may be up to substantially thirty six inches and the hub is of the order of up to approximately twenty four inches or more. Details and characteristics of the heavy-duty type of reel comprising the subject matter of this application are set forth hereinafter.

SUMMARY OF THE INVENTION

It is the principal object of the present invention to provide collapsible reels upon which relatively heavy loads of coiled material may be contained, and the connecting means between the segments of the multipart hub are readily connectable to and disconnectable from the flanges on which the inner surfaces are planar and the ends of the hub abut said planar surfaces, said flanges and hub segments having interengaging groove and rib means which effect firm connection of the hub to the flanges and are of such nature that the coiling of material upon the hub forces said connecting means into tighter interconnecting relationship.

Another object of the invention is to provide said groove and rib connecting means with sloping sides that are complementary to each other to facilitate the initial co-engagement of the same with each other incident to assembling the flanges with the hub segments and also providing wedge-type connection between such ribs and grooves.

Ancillary to the foregoing object, it is a still further object to provide such rib and groove connecting means with clearances of very limited nature adjacent the inner base of the grooves and adjacent surfaces of the ribs in order that there will be full reception of the ribs within the grooves when the hub segments are completely connected and assembled with respect to the flanges of the reel.

It is a still further object of the invention to provide the grooves of said connecting means upon relatively short, circular bosses which are either integrally connected to or are otherwise suitably affixed to said planar surfaces of the flanges, co-axially with the center of said flanges, which preferably are circular, said grooves extending into the peripheral surfaces of said bosses which preferably are cylindrical in nature, and the co-engageable ribs are formed on the arcuate, concave inner surface of the hub segments and are of complementary size and shape to the grooves for ready reception therein.

It is a further object of the invention to provide means to connect the segments of the hub firmly together and incidentally maintain the inner engaging rib and groove connecting means between the hub and flanges in operative relationship with each other, said connecting means comprising at least one bolt extending from each segment into the adjacent segment, the bolts of said segments being at opposite sides of the axis of the reel, said bolts being engageable with threaded means in the opposite segment, such as a nut embedded therein and said segments having axially aligned holes commonly therethrough to receive said bolts, the outer ends of said holes respectively being enlarged to provide sockets which receive the heads of said bolts and said nuts so that no portions of said bolts or nuts project beyond the cylindrical outline of the hub segments when assembled to form a preferably cylindrical surface.

Ancillary to the foregoing object, it is still another object to provide means by which the nuts preferably are embedded within a hub segment at the outer end of one of said aforementioned holes which is spaced transversely from another similar hole at the opposite side of the axis of said hub segment which receives the bolt, said bolt being rotatable within said hole but preferably said bolt is not movable axially so as to become separated from said segment, whereby there are no loose bolts and nuts to account for when the various elements of the reel are separated from each other and packaged compactly, for example, for return to the supplier for re-use after being re-assembled.

Details of the foregoing objects and the invention, as well as other objects thereof, are set forth in the following specification and illustrated in the accompanying drawing comprising a part thereof.

DETAILED DESCRIPTION

Figure 1:
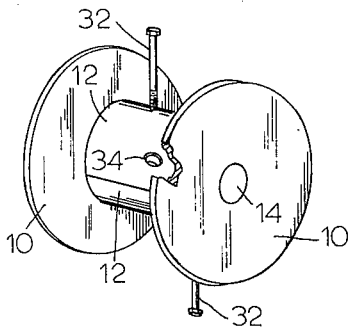
FIG. 1 is a perspective view of a collapsible reel embodying the principals of the present invention, part of one flange being broken away to show certain details thereof and said figure also showing several bolts in position to be installed operatively to secure the hub segment together.
Figure 2:
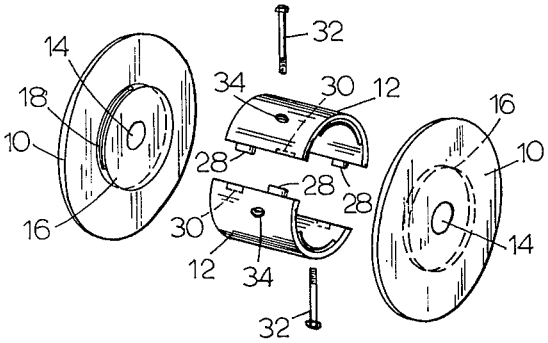
FIG. 2 is an exploded view showing all elements of the collapsible reel in expanded position.

Referring to the drawings and especially FIGS. 1 and 2, it will be seen that the preferred construction of a collapsible reel embodying the principals of the present invention includes a pair of similar flanges 10 and a pair of similar hub segments 12. In this embodiment, the flanges have been illustrated as circular discs but it's to be understood that the geometrical configuration of the periphery thereof may be other than the circle within the purview of the present invention. Said flanges are provided with central openings 14 through which a supporting axle may be extended for use incident to coiling or uncoiling material from the reel when assembled.

The inner faces of the flanges 10 preferably are planar with the exception of short, preferably cylindrical bosses 16 which are formed centrally of said planar surfaces of the flanges. Said bosses preferably are cylindrical and the peripheral surface thereof is provided with a plurality of arcuate grooves 18 which are of uniform depth.

Figure 3:
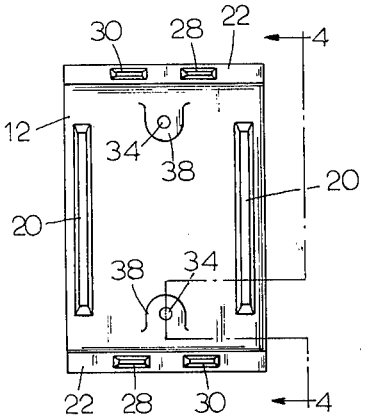
FIG. 3 is an enlarged plan view of one segment of the hub as viewed from the inner concave side thereof.
Figure 5:
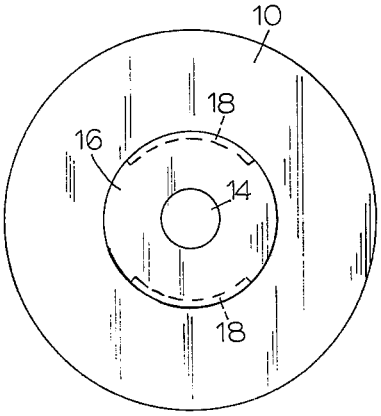
FIG. 5 is a side elevation of one of the flanges of the reel shown in FIGS. 1 and 2 as seen from the inner planar face thereof upon which a connecting boss is provided.
Figure 6:
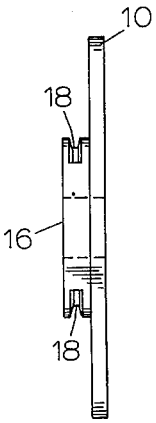
FIG. 6 is a side elevation of the flange shown in FIG. 5.

The hub segments 12 are preferably semi-cylindrical and the outer edges thereof are arranged to abut each other to form a tubular hub, not only to provide strength but also to save material. The concave inner surface of the hub segments 12, adjacent opposite ends thereof with respect to the axis, is provided with a pair of similar arcuate ribs 20 which are complementary both as to shape and size with the grooves 18. In the preferred construction, the ribs 20 do not extend to the ends 22 of the segments, whereby as seen in FIG. 5, the ends of the two grooves 18 are spaced from each other circumferentially. In FIG. 3, it will be seen that the ribs 20 are slightly spaced inwardly from the outer ends of the hub segments 12, in an axial direction, particularly for purposes of adding strength to the ribs for purposes of resisting axial flexing or other displacement of the ribs due, for example, to shock being imposed upon the same, especially in the handling of a reel when filled with relatively heavy material. However, if desired, the outer edges of the ribs 20 may be substantially co-incident with the adjacent ends of the hub segments 12.

Figure 8:
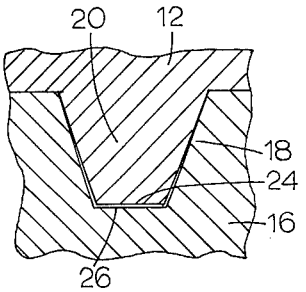
FIG. 8 is an enlarged transverse sectional view showing fragmentary portions of a hub segment and flange boss and illustrating the details of the co-engaging rib and groove means comprising the means for interlocking the hub segments to the flanges.

An important feature of the present invention comprises the fact that the inner surfaces of the flanges 10 are planar and the bosses 16 project from said planar surfaces. The bosses 16 may be formed integrally with said flanges or, if desired, they may be formed separately and fixedly connected appropriately against the planar inner faces of the flanges 10, by any suitable means, of a detachable nature, or permanently fixed nature. The diameter of the bosses 16 is preferably precisely equal to the inner diameter of the hub segments 12 when connected together to form a cylindrical hub. Accordingly, when the hub segments 12 are connected to the flanges 10, the opposite ends of the segments 12 will closely abut the planar surfaces of the flanges 10. In view of this, assembly of the segments with the flanges is very readily and easily accomplished. To further facilitate such easy assembly, it will be seen especially from FIG. 8, that the opposite sides of the arcuate ribs 20 taper inwardly toward each other in a radially inward direction. Similarly, the opposite sides of the arcuate grooves 18 likewise are tapered in a complimentary manner to receive the ribs 20, thereby providing a somewhat camming effect. However, to insure that the ribs 20 will be fully received within the grooves 18 so that the inner cylindrical surfaces of the tubular composite hub comprising the segments 12 will firmly abut the perphiral surfaces of the bosses 16, there is illustrated in FIG. 8, in somewhat exaggerted manner, the fact that the sides of the arcuate ribs 20 taper slightly more sharply than the sides of the grooves 18 but it is preferred that the transverse dimension of the roots of the ribs 20 is precisely equal to the transverse width of the outer ends of the grooves 18. Further, as also is evident from FIG. 8, the outer cylindrical surface 24 is slightly spaced from the bottom surface 26 of the grooves 18 so as to insure the firm engagement of the interior surface of the tubular hub 12 with the peripheral surface of the bosses 16. By way of example, the clearances between the various surfaces illustrated in FIG. 8 is preferably a matter of only several thousandths of an inch, at least in the smaller sizes of reels contemplated for employment of the present invention but, in the larger sizes of reels, such clearances may be of a somewhat greater dimension then a few thousandths but the precise transverse dimensions of the roots of the ribs and outer ends of the groove applies in even the larger sizes of reels.

The flanges 10 and hub segments 12 may be made from a number of different types of suitable materials, one of the preferred materials however, being suitable types of synthetic resin or plastics, structural foam or otherwise. Likewise, appropriate metal may be employed, especially lighter weight metals such as magnesium and aluminum. Under some circumstances and particularly in the larger sizes of the reels, combinations of materials may be employed such as the flanges being made from wood, such as plywood and the bosses 16 may be made from either wood or other appropriate material and the grooves 18 are appropriately formed in said bosses. Under such circumstances, the hub segments 12 may be formed from suitable moldable material such as synthetic resin or metal.

Further to facilitate the alignment and also to maintain the abutting edges or ends 22 of the segments in firm and accuate alignment with each other, especially to form a preferably cylindrical exterior surface for the hub, the ends 22 of said segments are each provided with aligning lugs 28 and complimentary elongated recesses 30. Each end 22 of said hub segment contains at least one aligning lug 28 and one elongated recess 30. Also, as clearly shown in FIG. 3, said lugs and recesses on the opposite ends are disposed in reverse relationship to each other in order that a pair of the hub segments may be suitable aligned with each other by disposing the lug 28 on one surface adjacent one end of the segment with the recess on the engaging end of the other segment which is nearest the same end of the segment, thereby rendering it possible to manufacture only one arrangement of hub segment 12 for each size of reel and thereby minimize inventory and manufacturing expense. Further, the lugs 28 preferably are tapered at the opposite sides and ends and the recesses 30 are of a complimentary shape, thereby facilitating the assembly of the segments 12 with each other incident to connecting the segments with the flanges 10.

Figure 4:
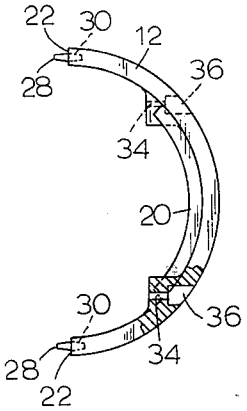
FIG. 4 is a partially sectioned side elevation of the hub segment illustrated in FIG. 3 as seen on the line 4—4 thereof.

Maintaining the hub segments 12 connected to each other and also, by means of the grooves 18 and ribs 20, with the flanges 10, is accomplished by very simple means. As shown in FIGS. 1 and 2, a pair of bolts 32 which are illustrated in exploded manner in said figures. Particularly in the smaller sizes of the range of different sizes in which the present invention is capable of being employed, a pair of bolts will be adequate to effect such connection and final assembly of all the components. To accommodate the bolts 32, each hub segment 12 is provided with a pair of holes 34, which are best shown in FIG. 4, terminating outwardly in sockets 36 which are of a larger diameter then the holes. The holes 34 are also formed preferably in molded bosses 38, as shown in FIGS. 3 and 4. The sockets 36 are of a sufficient diameter to receive the heads of the bolts 32. The holes 34 in a pair of the hub segments 12 when in a assembled relationship with each other are in axial alignment, whereby the opposite end of the bolt extends through the hole 34 in the opposite hub segments and the socket in said opposite segment accommodates a nut threadable onto the end of the bolt extending into said opposite segment.

From FIGS. 3 and 4 particularly, it will be seen that the holes 34 are parallel to each other in each segment and are on opposite sides of the axis of the tubular hub formed by a pair of said segments. In the larger sizes of reels and especially those designed to accommodate loads of substantial weight, such as the order of a number of hundred pounds, and particularly if the length of the hub segments 12 are greater then of the order of approximately twelve inches, it is contemplated within the purview of the present invention that two or more bolts 32, holes 34 and sockets 36 may be provided in the hub segments 12 in axial alignment with each other, respectively on opposite sides of the axis of the tubular hub. In addition, additional pairs of co-acting alinging lugs 28 and elongated recesses 30 may be required in the end surfaces 22 of the hub segments 12.

Figure 9:
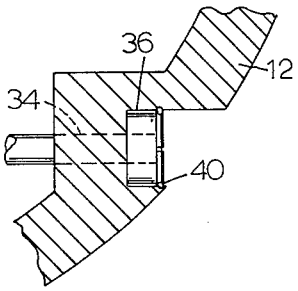
FIG. 9 is a fragmentary sectional view illustrating a preferred embodiment for maintaining a connecting bolt from axial removal from the hub segment in which it is disposed but permit rotation thereof.

Under some circumstances, the sizes and arrangement of the componenets of the composite reel and especially the hub segments 12 permitting, it is contemplated also within the purview of the invention that the nuts referred to above which are threadably engaged by the bolts 32 may be fixedly retained within the sockets 36, such as by the use of cement, locking rings or otherwise. Similarly, the bolts 32 may be rotatably mounted within the holes 34 and sockets 36 but are prevented from longitudinal removal therefrom, such as by the employment of a snap-ring 40, one typical example of which is illustrated in cross-section in FIG. 9. By such arrangement, particularly when the components of the reels are collapsed or dis-assembled for return to the supplier for re-use, it is not necessary to provide additional means to retain the bolts and nuts with said components such as by enclosing the same in an appropriate bag or other suitable package as is now necessary if such nuts and bolts are not irremovable from the segments by some means such as the exemplary construction described hereinabove.

Figure 7:
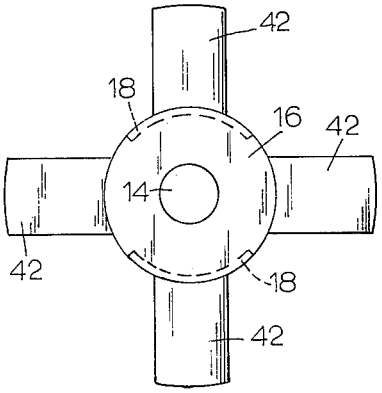
FIG. 7 is a view similar to FIG. 5 but showing another embodiment of flange arrangement in which a series of spider-like arms are employed instead of a disc to determine the end surfaces of the coil of material to be wound upon such embodiment of reel.

Although the most common configuration for flanges of reels is circular, as illustrated in FIGS. 1, 2 and 5, the present invention is adapted to reels in which other configurations of flanges may be employed such as the exemplary configuration shown in FIG. 7 in which a series of spider-like arms 42 are formed in any suitable manner and the boss 16 is connected thereto, either integrally or in a suitable fixed manner. As in regard to the flanges 10, the spider-like arms 42 may be formed from the same type of materials as described above with respect to the flanges 10 and said arm will define the width of the final coil of material which is contained upon the reel.

From the foregoing description and the illustrations contained in the drawing, it is apparent that as material is wound upon the hub segments 12, the coiled material will serve to maintain the segments 12 not only in operative relationship with each other but also will maintain the connecting means comprising the grooves 18 and ribs 20 in tight engagement with each other so that at least after the initial coiling of material upon the hub is undertaken, the bolts 32 become superfluous. Accordingly, the bolts 32 primarily are for purposes of effecting initial assembly of the reel and, conversely, removal of the bolts from engagment with the co-acting nuts in the segments will permit ready dis-assembly of the components of the reel to dispose them in collapsed condition for compact packaging and return to the supplier for reuse.

It is also to be understood that while the present illustration shows only a pair of the hub segments 12, which incidentally is the preferred construction thereof in accordance with the invention, it nevertheless is to be understood that the principles of the invention may be applied to reels in which more than two of the hub segments 12 are employed, particularly if the diameter of the hub, especially in the larger sizes of reels, renders the use of more then two segments desirable. Further, particularly in the larger sizes of reels of the range described herein, and especially for purposes of maintaining the thickness of the segments 12 at a minimum commensurate with strength to resist collapsing when material is coiled thereon, additional strength may be supplied by employing radially extending, arcuate ribs at axially spaced locations inward of the arcuate ribs 20 and preferably have the same integrally connected to the concave surfaces of the hub segments 12 so as to strengthen said segments against tendencies to bend. A series of circumferentially spaced, axially extending ribs formed on the concave surfaces of the hub segments 12 also may be employed for such strengthening purposes.

From the foregoing, it will be seen that the present invention provides a very simple construction which provides a collapsible reel which, particularly when the dimensions of the flanges and hub segments are suitably dimensioned, is capable of being manufactured in a range of sizes for so-called heavy duty use and particularly to accommodate coiled loads of wire-like or strip material within a range up to one thousand pounds or more but, conversely, the construction is such that it readily is adapted for use in smaller sizes of reels such as of the order of ten or twelve inches in diameter and six or eight inches in length. When the components are separated and collapsed, they may be compactly arranged either in suitable containers or otherwise appropriately packaged with a number of additional similar collapsed reels and thereby facilitate the return of the reels economically to a supplier for re-assembly and re-use.

While the invention has been described and illustrated in its several preferred embodiments, it should be understood that the invention is not to be limited to the precise details herein illustrated and described since the same may be carried out in other ways falling within the scope of the invention as illustrated and described.

I claim:

1. A collapsible reel comprising in combination, a pair of similar unitary flanges each having at least one planar face; a substantially tubular hub the opposite ends of which abut said planar faces of said flanges, said hub being composed of a plurality of similar arcuate segments having concave inner surfaces; and means detachably connecting said ends of said hub in abutting relationship respectively to said planar faces of said flanges comprising similar bosses fixed centrally to and extending axially from said planar faces of said flanges and having arcuate grooves in the peripheries of said bosses positioned therein axially outward from said planar faces of said flanges, said segments of said hub having on said concave surfaces thereof arcuate ribs complementary in shape and size to said arcuate grooves in said bosses and respectively received closely therein when said hub segments are positioned operatively between said flanges with the ends thereof abutting said planar faces of said flanges, and means connecting said segments to each other to maintain said hub connected operatively to said flanges.

2. The reel according to claim 1 in which the opposite sides of said arcuate ribs slope toward each other toward the outer ends thereof and the opposite sides of said arcuate grooves sloping toward each other from the periphery of said bosses toward the bottoms of said grooves to be substantially complementary to the shape and size of said arcuate ribs.

3. The reel according to claim 2 in which the outer ends of said arcuate ribs comprise a segment of a cylindrical surface of predetermined axial length and the bottom surfaces of said arcuate grooves are complementary thereto.

4. The reel according to claim 3 in which the transverse dimension of the root of said ribs is substantially precisely equal to the transverse dimension of the outer end of said grooves and the transverse dimension of the outer end of each rib being slightly less than the transverse dimension of the bottom surface of each groove, thereby insuring firm engagement between said ribs and grooves at the strongest part of each rib when the hub segments are connected to said flanges.

5. The reel according to claim 2 in which said grooves in the peripheries of said bosses on said flanges are of uniform depth and said arcuate ribs on said hub segments have a uniform height and the height of said ribs is slightly less than the depth of said grooves to insure firm engagement of the sides of said grooves and ribs with each other when said hub segments are connected to said flanges.

6. The reel according to claim 1 in which said hub segments comprise a pair of similar semi-cylindrical members, the axially extending outer edges thereof abutting each other when said segments are connected together, and said segments further including interfitting lugs and recesses respectively on said outer edges thereof to effect accurate alignment of said edges of said segments with each other when said segments are connected to said flanges.

7. The reel according to claim 6 in which each of said edges of said segments have a lug and a complementary recess thereon in longitudinal alignment along each edge, the lug and recess on one edge of each segment being in reverse relationship to the lug and recess on the other edge of each segment, whereby the lugs and recesses on a pair of identical segments will interfit when the edges thereof are in abutment.

8. The reel according to claim 6 in which the opposite ends of the arcuate ribs on said hub segments respectively are spaced inwardly from the abuttable edges of said segments similar predetermined short distances and the arcuate grooves in the peripheral surfaces of said bosses on said flanges are complementary in length to said ribs, whereby the opposite ends of said grooves on each boss are spaced similar distances in arcuate directions from each other.

9. The reel according to claim 6 in which said means connecting said segments to each other comprise at least a pair of bolts extending respectively through portions of said hub segments respectively at opposite sides of the axis of said hub and inward from the abutting edges of said segments, and threaded means in the opposing segment engageable with said bolts, the heads of said bolts and said threaded means being recessed into said segments below the exterior semi-cylindrical surface thereof so as not to be contacted by material when coiled upon said reel.

10. The reel according to claim 9 in which one bolt is rotatably mounted respectively in each hub segment and extends through a hole in the opposite segment and said threaded means engageable with said bolts comprise complementary nuts anchored within said holes in said opposite segments, said segments further including securing means within said segments engageable with the bolt heads mounted therein and operable to permit rotation of said bolts but prevent axial removal movement of said bolts from said segments, said securing means being recessed below the outer cylindrical surface of said hub segments.

* * * * *